US010472153B2

(12) United States Patent
Testa

(10) Patent No.: US 10,472,153 B2
(45) Date of Patent: Nov. 12, 2019

(54) CONTAINER FOR LIQUID WITH A DOSING MECHANISM

(71) Applicant: MADEL S.P.A., Cotignola (Ravenna) (IT)

(72) Inventor: Mattia Testa, Lugo (IT)

(73) Assignee: MADEL S.P.A., Cotignola (Ravenna) (IT)

( * ) Notice: Subject to any disclaimer, the term of this patent is extended or adjusted under 35 U.S.C. 154(b) by 0 days.

(21) Appl. No.: 15/778,975

(22) PCT Filed: Dec. 7, 2016

(86) PCT No.: PCT/IB2016/057412

§ 371 (c)(1),
(2) Date: May 24, 2018

(87) PCT Pub. No.: WO2017/130041

PCT Pub. Date: Aug. 3, 2017

(65) Prior Publication Data

US 2018/0346217 A1 Dec. 6, 2018

(30) Foreign Application Priority Data

Jan. 26, 2016 (IT) ..... 102016000007774

(51) Int. Cl.
*B65D 75/00* (2006.01)
*B65D 75/58* (2006.01)
(Continued)

(52) U.S. Cl.
CPC ..... *B65D 75/008* (2013.01); *B65D 75/566* (2013.01); *B65D 75/58* (2013.01);
(Continued)

(58) Field of Classification Search
CPC .... B65D 75/008; B65D 75/566; B65D 75/58; B65D 75/5883; B65D 81/3261; B65D 2575/586
(Continued)

(56) References Cited

U.S. PATENT DOCUMENTS 3,052,385 A * 9/1962 Tindall ..... B65D 5/76 222/454
4,890,744 A * 1/1990 Lane, Jr. ..... B65D 75/5822 206/484
(Continued)

FOREIGN PATENT DOCUMENTS

EP 2492210 A1 8/2012
EP 2792615 A1 10/2014
(Continued)

OTHER PUBLICATIONS

International Search Report and Written Opinion dated Feb. 14, 2017 from counterpart PCT App No. PCT/IB2016/057412.

*Primary Examiner* — Benjamin R Shaw
(74) *Attorney, Agent, or Firm* — Shuttleworth & Ingersoll, PLC; Timothy J. Klima

(57) ABSTRACT

A container, preferably a flexible packaging, including a base wall, a front face wall, a rear face wall, at least a first sealing for joining the front and rear face walls, at least a second sealing for joining the front face wall and the rear face wall with the base wall to form a sealed enclosure; the container has an outlet opening and includes a plurality of inner seals for joining the front face wall with the rear face wall for delimiting a dosing chamber, in fluid communication with the outlet opening, and a storage chamber, in communication with the dosing chamber.

12 Claims, 5 Drawing Sheets

(51) Int. Cl.
*B65D 81/32* (2006.01)
*B65D 75/56* (2006.01)

(52) U.S. Cl.
CPC ..... *B65D 75/5883* (2013.01); *B65D 81/3261* (2013.01); *B65D 2575/586* (2013.01)

(58) Field of Classification Search
USPC ..... 222/207, 95, 424.5, 454, 456
See application file for complete search history.

(56) References Cited

U.S. PATENT DOCUMENTS

| | | | | | |
|---|---|---|---|---|---|
| 5,071,039 | A * | 12/1991 | Anglehart | B67D 7/0222 | 222/158 |
| 2003/0029884 | A1* | 2/2003 | Rau | B65D 75/58 | 222/92 |
| 2006/0255068 | A1* | 11/2006 | Genosar | B05B 11/0037 | 222/207 |
| 2008/0149666 | A1* | 6/2008 | LaFlamme | B65D 35/40 | 222/105 |
| 2010/0054636 | A1* | 3/2010 | Owensby | B65D 33/004 | 383/38 |
| 2011/0200379 | A1* | 8/2011 | de Gery | B65D 81/3261 | 401/25 |
| 2014/0054294 | A1* | 2/2014 | Rothenbuhler | B65D 75/58 | 220/501 |
| 2018/0319562 | A1* | 11/2018 | Rodman | B65D 75/008 | |

FOREIGN PATENT DOCUMENTS

| | | | |
|---|---|---|---|
| GB | 2227228 | A | 7/1990 |
| JP | 2001139072 | A | 5/2001 |

* cited by examiner

CONTAINER FOR LIQUID WITH A DOSING MECHANISM

This application is the National Phase of International Application PCT/IB2016/057412 filed Dec. 7, 2016 which designated the U.S.

This application claims priority to Italian Patent Application No. 102016000007774 filed Jan. 26, 2016, which application is incorporated by reference herein.

TECHNICAL FIELD

This invention relates to a container and in particular a container for a refill of a liquid product, for example soap; for convenience, express reference is hereinafter made to liquid detergent for washing machines, but without thereby limiting the scope of the invention.

BACKGROUND ART

The liquid detergents for washing machines are generally packed in rigid plastic bottles equipped with a relative cap.

The cap usually acts also as a doser for the detergent in order to obtain the correct dosage for introduction in the washing machine.

These bottles are usually made of plastic materials, are bulky and the relative disposal is sometimes problematic; the overall size of the bottles also implies the need for considerable space in the sale displays.

In order to limit the proliferation and the consumption of these containers the concept has been developed of "refills".

The so-called "refills", as mentioned above, comprise a container, generally in the form of a flexible and deformable bag, also referred to in the trade as a "pouch" or "flexible packaging", in which liquid detergent is inserted in a quantity suitable to constitute a refill for the bottle and designed to be poured into the bottle once the product inside it has finished.

In this way, the bottle may be repeatedly reused, allowing a considerable saving of plastic, also from an environmental sustainability point of view.

The bags, made, in short, from layered film, are generally provided with a spout, from which the product is free to escape, equipped with a normal screw cap.

Since they are effectively more practical to use, even and above all due to the reduced overall size of the bags, the refills are often used for directly filling the drawer of the washing machine.

A limitation of these bags derives from the fact that, without a corresponding bottle or at least a cap/doser, the product inside them cannot be conveniently dosed and, in the event of direct use, this determines further drawbacks.

On the one hand, if a quantity of product is used which is less than that recommended, the result of the washing could be poorer than expected whilst, on the other hand, if more than necessary is used, there is an excessive consumption of detergent.

In this context, the main aim of this invention is to overcome the above-mentioned drawbacks of the containers for refills.

DISCLOSURE OF THE INVENTION

The aim of this invention is to provide a container for a refill which can also be directly used in daily use without the need for further dosers.

Another aim of this invention is to provide a container for refills which allows the dosing of the detergent inside it.

A further aim of the invention is to provide a container for refills which is inexpensive and relatively not bulky.

Another aim of this invention is to provide a container for refills which is more effective in environmental terms and from a cost saving point of view.

The technical purpose indicated and at least the aims specified are substantially achieved by a container according to the present disclosure.

BRIEF DESCRIPTION OF THE DRAWINGS

Further features and advantages of this invention are more apparent from the non-limiting description which follows of a preferred, non-limiting embodiment of a container for refills as schematically illustrated in the accompanying drawings, in which.

DETAILED DESCRIPTION OF PREFERRED EMBODIMENTS OF THE INVENTION

Figure 1:
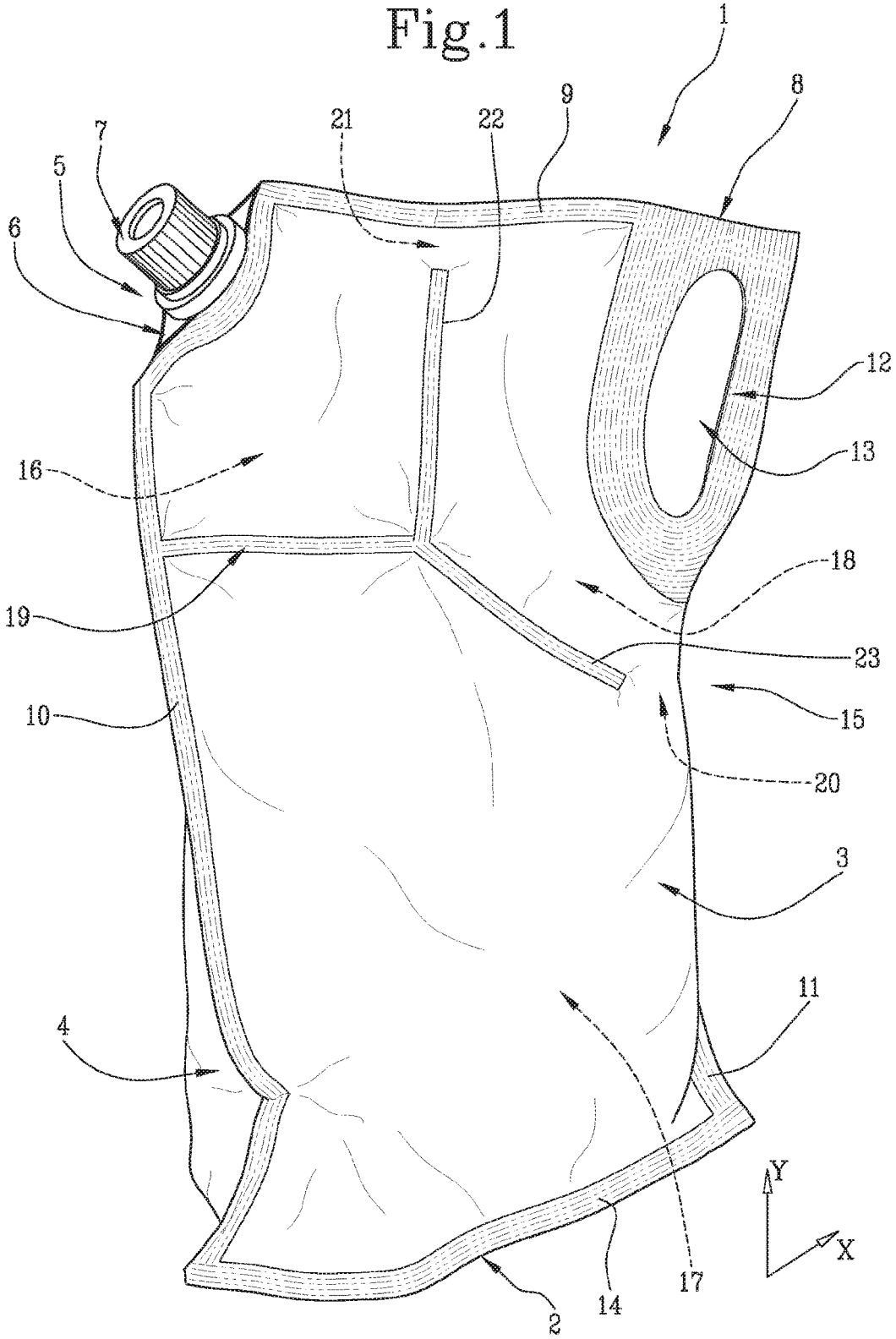
FIG. 1 is a schematic perspective view of a container according to this invention.

With reference to the accompanying drawings, the numeral 1 denotes a container according to this invention.

The container 1 is of the 'pouch' or 'flexible packing' or 'bag' type which is substantially known and described only insofar as necessary for understanding of this invention.

In short, the container 1 is preferably made of layered film, for example, a triple layer film, which is suitably sealed.

The container 1 is preferably intended for containing a refill of a liquid product such as, for example, detergent for washing machines to which explicit reference is made hereinafter.

In general, the container 1 may contain any product, such as, for example, bleach, windscreen washer liquid, food liquids such as pulped tomatoes, concentrated broth, products in powder, seeds.

In the embodiments illustrated by way of example, the container 1 comprises a base wall 2, a front face wall 3 and a rear face wall 4.

The base wall 2 is preferably of the concertina type and extends between the walls 3 and 4 in a lower portion of the container 1.

The container 1 has an outlet opening 5 preferably equipped with a corresponding spout 6 provided with a corresponding the cap 7.

In the embodiments illustrated, the outlet opening 5 is located on the side opposite the base wall 2 along a direction Y of vertical extension of the container 1.

The container 1 has at least one sealing 8 for joining the wall 3 with the wall 4.

More specifically, the sealing 8 comprises an upper branch 9, a first lateral branch 10 and a second lateral branch 11, that is to say, it is composed of an upper sealing 9, a sealing 10 and a lateral sealing 11.

The outlet opening 5 is, for example, located between the first lateral branch 10 and the upper branch 9 with the spout 6 held and joined to the walls 3 and 4 in a substantially known manner.

On the opposite side relative to the spout 6, considering a transversal direction X of extension of the container 1, the container is provided with a gripping handle 12.

In the embodiment illustrated, the handle 12 is, for example, obtained by means of a hole 13 which passes through the walls 3 and 4, suitably joined together in the zone of the handle 12.

The container 1 has a pair of base sealings 14 joining the front walls 3, 4 to the base wall 2.

The walls 2, 3 and 4 joined to each other by the sealings 8 and 14 define a sealed enclosure 15.

The container 1 comprises means for joining, for example, as explained in more detail below, of the sealings, of the front face wall 3 with the face wall 4 for separating, inside the enclosure 15, a chamber 16 for dosing detergent, in fluid communication with the opening 5, and a chamber 17 for storage of the product in communication with the chamber 16.

The joining means define barriers to the product packaged in the container 1 in such a way as to define preferential paths for the product once it is poured outside the container 1 through the outlet opening 5.

The dosing chamber 16 is preferably made at the opening 5 and in direct communication, that is to say, without the interposing of conduits or the like, with the spout 6. In other words, the spout 6 is directly connected to the chamber 16.

The chamber 16 is sized in such a way as to contain a predetermined dose of the product packaged in the container 1.

For example, in the case of detergent, the chamber 16 contains preferably between 70 and 85 ml of product according to its concentration.

On the basis of the material with which the container 1 is made and having fixed the dose which must be contained in the dosing chamber 16 the dimensions of the chamber 16 are determined.

The above-mentioned joining means comprise means for pouring the product inserted in the enclosure 15, from the storage chamber 17 to the dosing chamber 16.

Basically, in use, as will be explained below, the pouring means allow a user to pour a quantity of product from the storage chamber 17 to the dosing chamber 16 in such a way as to obtain a predetermined dose of the product, corresponding to that substantially contained in the chamber 16.

In a preferred embodiment, the wall 3 and/or the wall 4 are at least partly transparent at the dosing chamber 16 in such a way as to allow a view of the product poured, in the manner described below, in the chamber 16.

In an embodiment not illustrated, a transparent portion of the wall 3 and/or 4 at the chamber 16 is provided with a graduated scale.

With reference to FIGS. 1 to 4, in one embodiment the above-mentioned joining means also define, inside the enclosure 15, a chamber or conduit 18 for passage between the storage chamber 17 and the dosing chamber 16.

According to an embodiment, the conduit 18 extends partly along the direction X and partly along the direction Y.

In practice, the storage chamber 17 is in communication with the dosing chamber 16 by means of the conduit 18.

In the embodiments illustrated, the joining means 19 comprise a sealing between the front face wall 3 and the rear face wall 4.

The sealing 19 comprises a plurality of branches or stretches which separate the dosing chamber 16 from the storage chamber 17 and from the passage chamber 18 and which separate the passage conduit 18 from the storage chamber 17.

In practice, the sealing 19 and the sealing 10 delimit the dosing chamber 16 and the sealing 19 and the sealings 9 and 11 delimit the conduit 18.

The above-mentioned pouring means comprise a first opening 20 between the storage chamber 17 and the passage chamber 18 and a second opening 21 between the passage chamber 18 and the dosing chamber 16.

In other words, the conduit 18 has an inlet 20, through which the product may enter the conduit 18 from the storage chamber 17, and an outlet 21 through which the product may flow from the conduit 18 to the dosing chamber 16.

In one embodiment, the sealing 19 comprises a first branch or stretch 22 for delimiting the dosing chamber 16 extending preferably between the lateral branch 10 and the upper branch 9 of the sealing 8 around the opening 5.

As illustrated, the opening 21 is located along the branch 22.

The stretch 22 starts from the stretch 10 of the sealing 8 and extends towards the upper branch 9 from which it is separated by the presence of the outlet 21.

Preferably, the opening 21 is positioned at a height, measured along the direction Y, substantially corresponding to the height of the spout 6.

Figure 2:
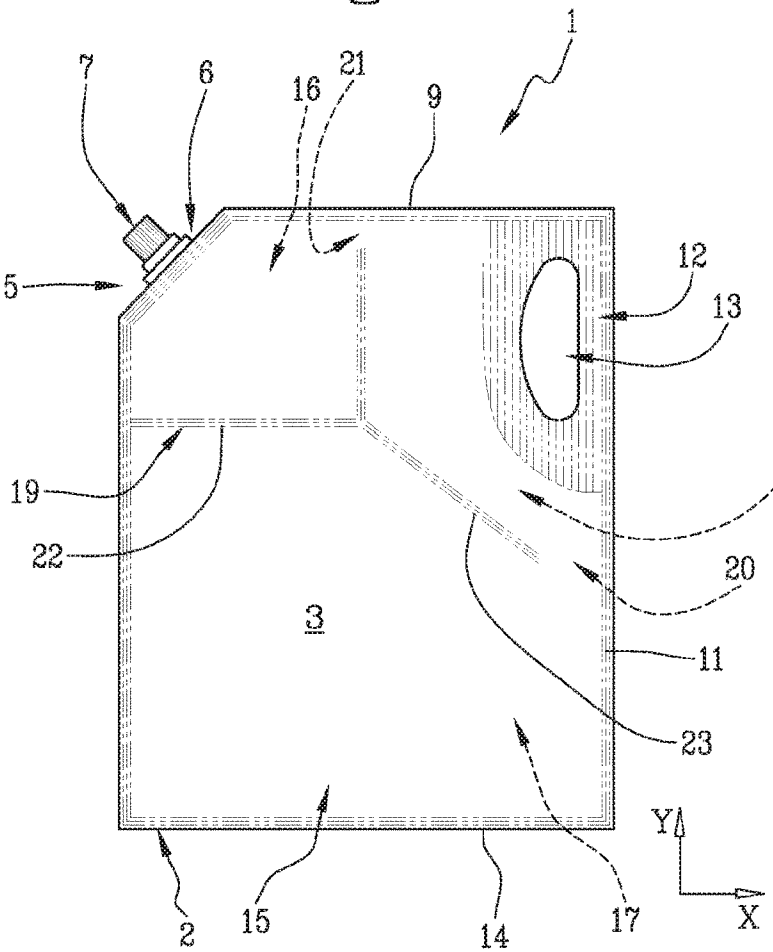
FIG. 2 is a schematic side view of the container of FIG. 1.

In the embodiment illustrated by way of example in FIGS. 1 and 2, the branch 22 is composed of two straight segments suitably set at an angle.

Figure 3:
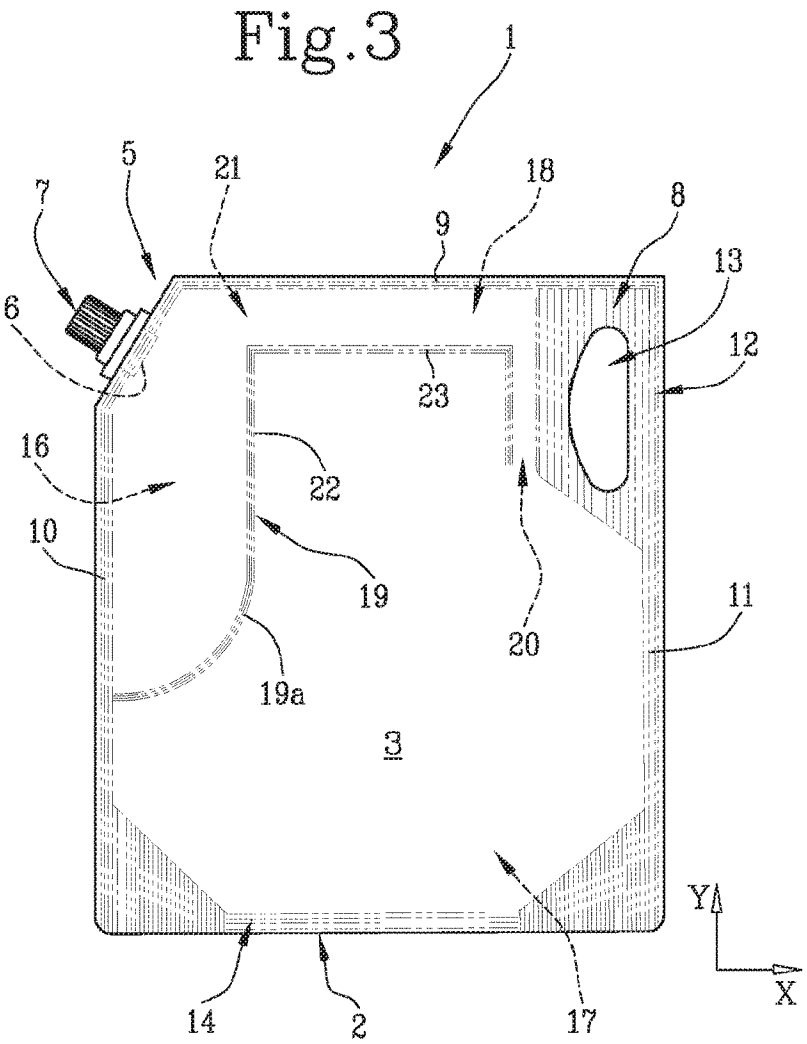
FIG. 3 is a schematic side view of a second embodiment of a container according to this invention.
Figure 4:
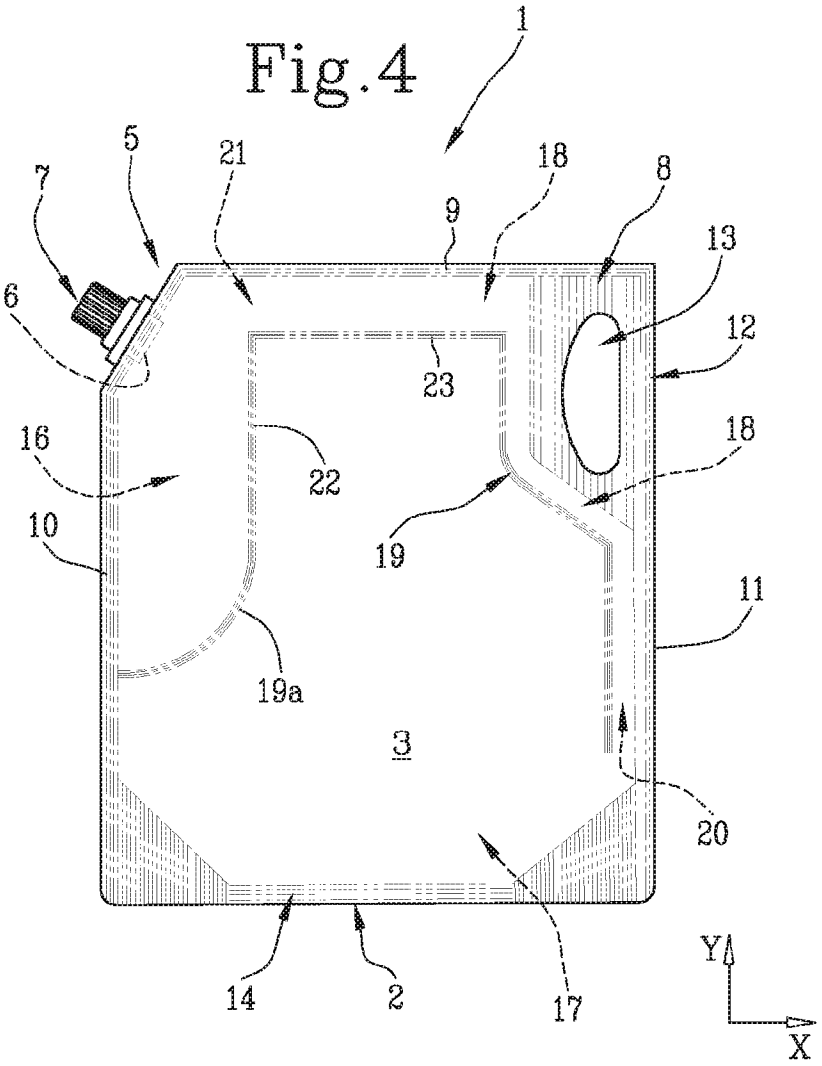
FIG. 4 is a schematic side view of a third embodiment of a container according to this invention.

In the embodiment illustrated by way of example in FIGS. 3 and 4, the branch 22 is composed of a curved stretch starting from the sealing 10 and by a stretch parallel to the main axis Y which projects from the curved stretch towards the sealing 9.

The sealing 19 comprises a second branch 23 extending from the branch 22 on the opposite side relative to the chamber 16, that is, towards the branch 11 of the sealing 8. The branch 23 separates, in practice, the chamber or conduit 18 for passage from the storage chamber 17.

In one embodiment, the opening 20 is defined between the branch 23 and the branch 11 of the sealing 8.

In the embodiment illustrated in FIGS. 1 and 2, the branch 22 and the branch 23 of the sealing 19 define a Y-shaped structure of which the branch 22 defines the prongs.

The outlet opening 5 is preferably located between the prongs of the Y-shaped structure which therefore surround the outlet opening 5.

The prongs of the "Y" extend preferably one in the direction X and the other in the direction Y.

In alternative embodiments not illustrated, the branches 22 and 23 are curved, in the form of an arc of a circle, made up of segments which are circular or have any other shape or direction.

In the embodiment illustrated in FIGS. 3 and 4 the branch 23 extends starting from the opening 21, that is to say, from a free end of the branch 22, in the direction X.

The branches 22 and 23 are preferably made as a single continuous sealing and indicated in order to better describe this solution.

The branch 23 has, in the example illustrated, a horizontal stretch according to the direction X and a vertical stretch according to the direction Y.

In use, starting from the vertical position of FIGS. 1 and 2, in order to fill the chamber 16 with part of the product contained in the chamber 17, it is necessary rotate the container 1, for example anticlockwise, until the chamber 18 is at a lower height, along the direction Y, relative to the chamber 17.

The detergent flows through the opening 20 from the chamber 17 in the conduit 18; if necessary, the pouring may be facilitated by applying repeated pressure on the container 1, in such a way as to pump the product in the chamber 18 whilst also keeping the container 1 vertical.

Once the chamber 18 is filled, by a second rotation, the product may be poured in the chamber 16 bringing the latter to a lower height, along the direction Y, relative to the chamber 18.

The product flows in the chamber 16 through the opening 21, if necessary facilitated by a pumping action, until it fills the chamber 16 which, as mentioned, is designed to contain a predetermined dose of product.

Once the chamber 16 is filled, repositioning the container 1 in the configuration of FIGS. 1 and 2 provides the desired dose in the chamber 16 and the rest of the product in the storage chamber 17.

Starting from this configuration, it is possible to pour the dose from the chamber 16 to the outside of the container 1 through the spout 6 without other product reaching the opening 5.

The chamber 18 constitutes an antechamber which separates the contents of the bag, that is to say, the product in the storage chamber 17 from the dosing chamber 16.

The chamber 18 defines a "non-return" device for the product such that, on the one hand, the product poured in the chamber 16 cannot return in the chamber 17 and, in a parallel fashion, other product, in addition to the that already present in the chamber 16, cannot reach the opening 5 during discharge of the detergent through the spout 6.

In use, with a container 1 in accordance with the embodiments of FIGS. 3 and 4, the product can be supplied from the chamber 17 to the chamber 16 through the conduit 18 by repeatedly squashing the container 1.

Alternatively, the product may be poured in the chamber 16 by rotating the container, in such a way that the product flows along the conduit 18.

Once the product is in the chamber 16 it may no longer accidentally return backwards due to the presence of the conduit 18.

The conduit 18 constitutes a sort of antechamber which separates the contents of the bag, that is to say, the product in the storage chamber 17 from the dosing chamber 16.

The conduit 18 defines a "non-return" device for the product such that, on the one hand, the product poured in the chamber 16 cannot return in the chamber 17 and, in a parallel fashion, other product, in addition to the that already present in the chamber 16, cannot reach the opening 5 during discharge of the detergent through the spout 6.

FIGS. 3 and 4 show further embodiments of the container according to this invention.

Generally speaking, the container 1 is of the type previously described and the reference numerals are the same.

As illustrated, the above-mentioned joining means comprise a sealing 24 for separating the dosing chamber 16 from the storage chamber 17.

The sealing 24 is made between the front face wall 3 and the rear face wall 4 and extends preferably between the upper branch 9 and the lateral branch 10 around the opening 5.

In the embodiments illustrated by way of example, the sealing 24 comprises a first segment **24*a* parallel to the direction X and a second segment 24*b*** parallel to the direction Y.

Figure 6:
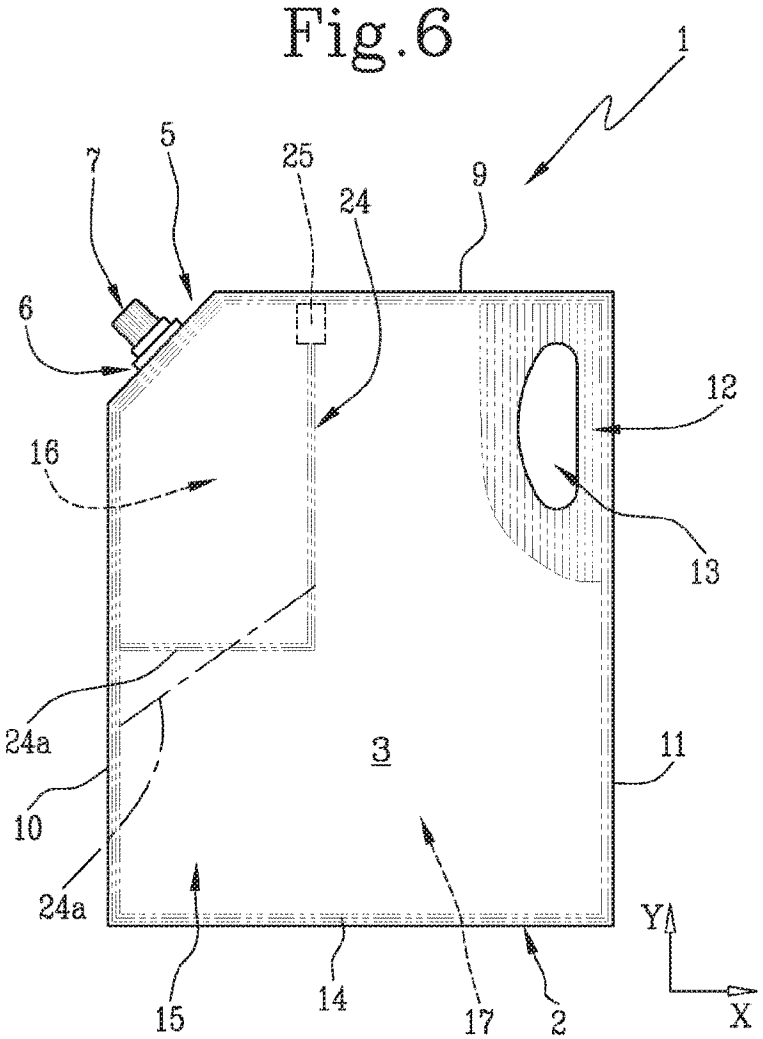
FIG. 6 is a schematic side view, partly in blocks, of a fifth embodiment of a container according to this invention.

In alternative embodiments, as schematically illustrated in FIG. 6 with a dashed line, the segment **24*a* is inclined relative to the direction X for imparting greater stability to the container 1**.

The above-mentioned pouring means comprise a valve, schematically illustrated with a corresponding block 25, positioned along the sealing 24 between the wall 3 and the wall 4.

The dosing chamber 16 and the storage chamber 17 are separated by the sealing 24 and in communication through the valve 25.

The valve 25 can be operated mechanically by means of an external pressure, exerted from the outside of the container 1, for example against the walls 3 and 4 at the valve 25.

In one embodiment, the valve 25 is preferably of the type which is normally closed and which can be opened by the above-mentioned external pressure.

In one embodiment, the valve 25 is preferably of the type which is normally open and which can be opened by the above-mentioned external pressure.

In the latter case, the valve 25 is preferably in the form of an opening which the pressure on the walls 3, 4 closes by moving the walls 3, 4 in contact with each other.

In the embodiment illustrated by way of an example in FIG. 6, the valve 25 is located to the height of the outlet opening 5 along the direction Y.

In the example embodiment illustrated by way of an example in FIG. 4, the valve 25 is aligned with the outlet opening 5 along the direction Y.

Considering the embodiment of FIG. 6, in order to fill the chamber 16 in use it is necessary to rotate the container 1, for example, in an anticlockwise direction, to carry the product to the valve 25.

If the valve 25 is normally open the product will pour normally in the chamber 16 whilst if the valve is normally closed it will be necessary to apply a pressure on it to allow the pouring of the product from the chamber 17 to the chamber 16.

Once the chamber 16 is filled, the product may be poured from the container 1 through the spout 6; if the valve 25 is of the type normally open it is necessary to keep it closed, for example by pressure, to prevent additional product entering the chamber 16.

Figure 7:
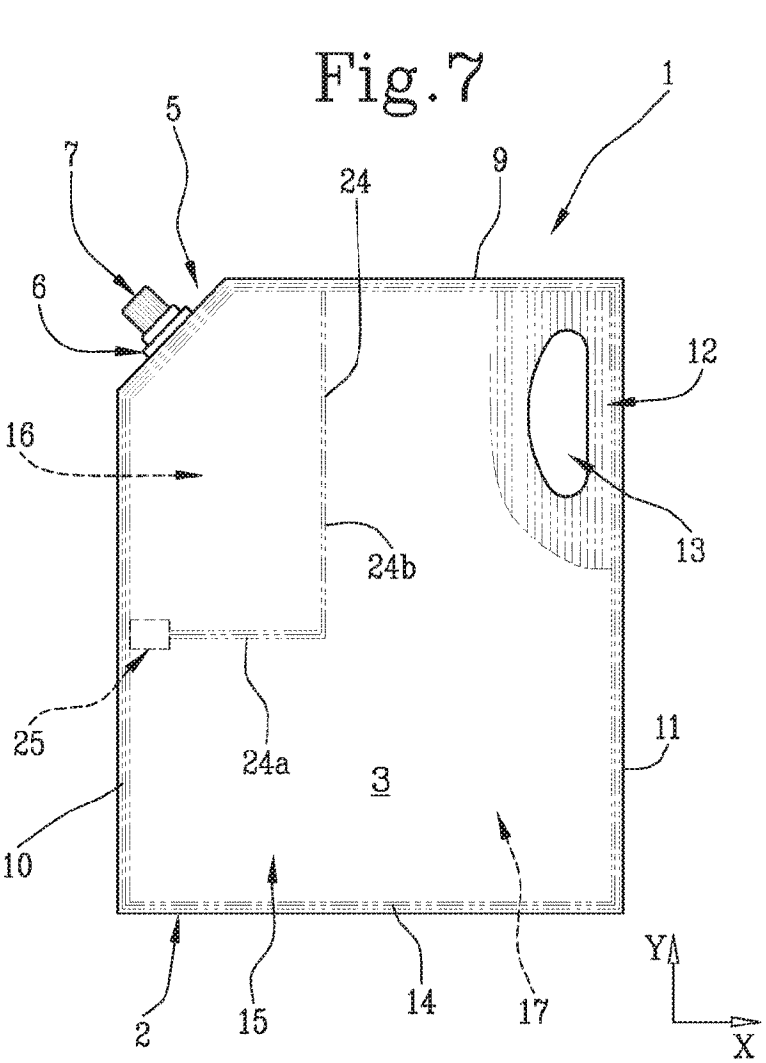
FIG. 7 is a schematic side view, partly in blocks, of a sixth embodiment of a container according to this invention.

The container of FIG. 7 has an operation substantially similar to the container of FIG. 6, with modification of the rotations of the container 1 determined by the different positioning of the valve 25 relative to the embodiment of FIG. 6.

Figure 5:
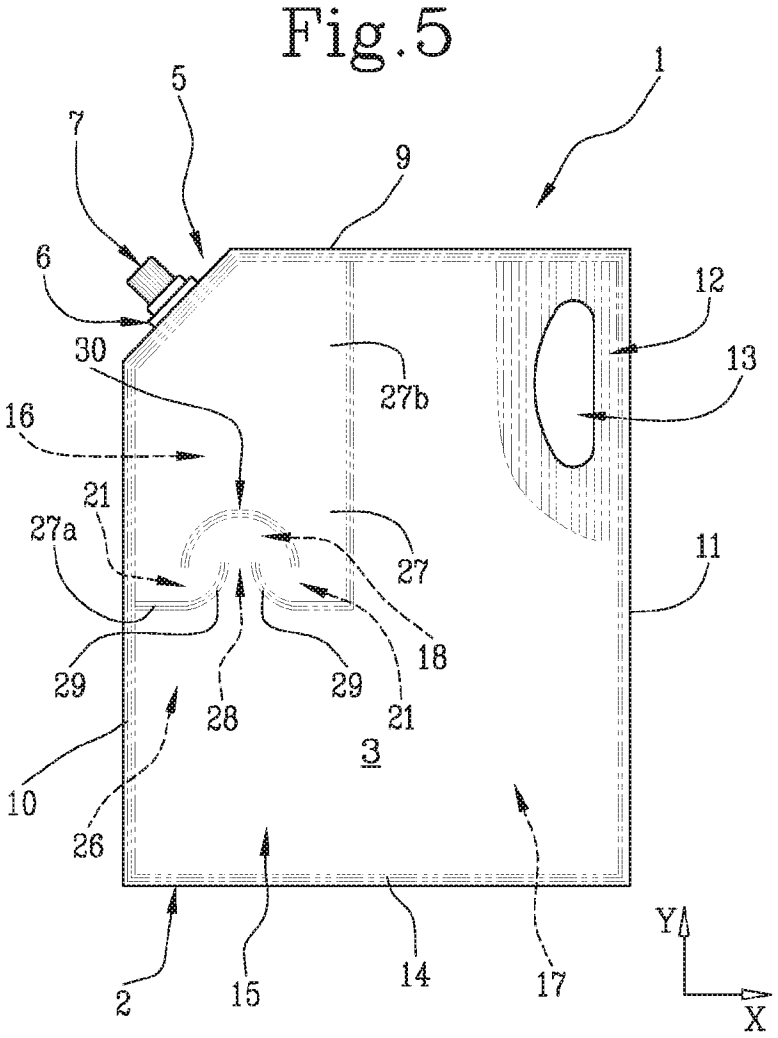
FIG. 5 is a schematic side view of a fourth embodiment of a container according to this invention.

A preferred embodiment of the container 1 illustrated in FIG. 5 comprises a one-way valve 26.

The above-mentioned joining means comprise a sealing 27 for separating the dosing chamber 16 from the storage chamber 17.

The sealing 27 is made between the front face wall 3 and the rear face wall 4 and extends preferably between the upper branch 9 and the lateral branch 10 around the opening 5.

In the embodiment illustrated by way of example, the sealing 27 comprises a first segment 27*a* parallel to the direction X and a second segment 27*b* parallel to the direction Y.

The valve 26 is inserted along the sealing 27 and allows the passage of the product exclusively from the storage chamber 17 to the dosing chamber 16 and not vice versa.

In the preferred embodiment illustrated by way of example, the valve 26 comprises an opening 28, along the sealing 27*a*, delimited by a pair of guide sealings 29; the sealings 29 extend from the sealing 27*a* towards the chamber 16.

The valve 26 comprises a non-return sealing 30 aligned with the opening 28 according to the direction Y; the sealing 30 is preferably in the shape of an arc with the concavity facing the opening 28.

The sealing 30 delimits, with the sealings 29, a conduit 18 for passage of the product which flows from the opening 28, corresponding to the above-mentioned opening 20, to two outlets 21 through which the product reaches the dosing chamber 16.

In use, to obtain a dose of product ready to be poured it is possible to fill the chamber 16 from the chamber 17 through the valve 26.

By turning over the container 1 with the cap closed, the valve 26 allows the passage of the product from the chamber 17 to the chamber 16.

The sealing 30 prevents a return of the product from the chamber 16 to the chamber 17 when the container 1 is in the position illustrated in FIG. 5.

Once the chamber 16 is filled, the product contained in it may be poured outside the enclosure 15 by the spout 6.

Figure 8:
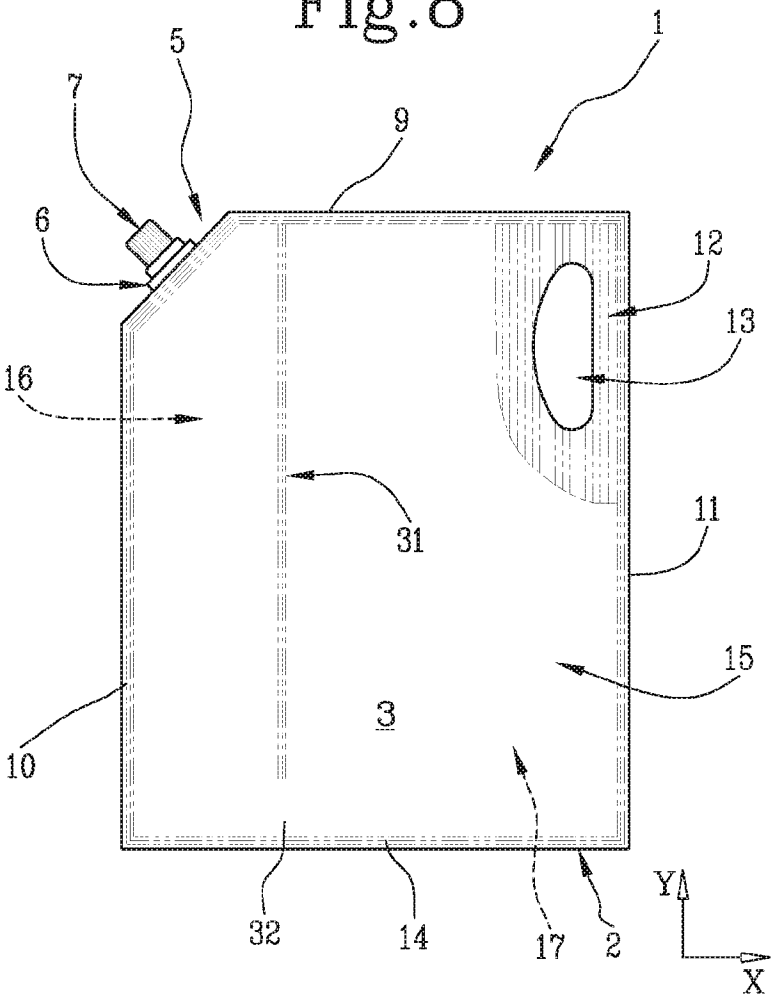
FIG. 8 is a schematic side view of a seventh embodiment of a container according to this invention.

FIG. 8 shows a further embodiment of the container according to this invention.

As illustrated, the above-mentioned joining means comprise a sealing 31 for separating the dosing chamber 16 from the storage chamber 17. The chamber 16 is, in practice, in the form of a channel.

The sealing 31 is made between the front face wall 3 and the rear face wall 4 and extends preferably starting from the branch 9 along the direction Y.

The pouring means comprise an opening 32 made between the wall 3 and the wall 4 along the sealing 31; preferably, the opening 32 is located close to the base wall 2.

The dosing chamber 16 and the storage chamber 17 are separated by the sealing 31 and in communication through the opening 32.

In use, by positioning the outlet opening 5 at the bottom, considering the direction Y, the filling of the chamber 16 and the formation of the corresponding dose is obtained; once the cap 7 is opened, only the escape of the product present in the chamber 16 is substantially obtained.

In general, the container contains both the product and air which guarantees the mobility of the product between the separate chambers.

Advantageously, both the quantity of product and the quantity of air inside the bag can be conveniently dosed as a function of the above-mentioned mobility needs.

The invention as described above brings important advantages.

The additional sealings, as well as those necessary for defining the structure of the bag, allow the product to be confined in predetermined zones in such a way that it can be dosed.

The forming of a dosing chamber from which to extract the product allows a direct use of the refill, without the need for bottles or caps or additional dosers.

The flexible packaging provided with a dosing chamber allows an optimum use of the product packaged inside it.

The defining of the preferential chambers by means of additional sealings does not entail, substantially, any increase in cost relative to a traditional "pouch", in particular due to the fact that the quantity of material used in the making of the container remains substantially unchanged.

The invention claimed is:

1. A container, comprising:

a base wall, a front face wall, and a rear face wall, a first sealing joining the front face wall and the rear face wall, the first sealing including a first lateral branch and an upper branch, a second sealing joining the front face wall and the rear face wall with the base wall to form a sealed enclosure, an outlet opening positioned between the first lateral branch and the upper branch, a joining seal joining the front face wall with the rear face wall for delimiting inside the sealed enclosure a dosing chamber in fluid communication with the outlet opening and a storage chamber in fluid communication with the dosing chamber, the joining seal defining, inside the sealed enclosure, a conduit for passage between the storage chamber and the dosing chamber, the storage chamber being in communication with the dosing chamber through the conduit, the joining seal including a third sealing between the front face wall and the rear face wall, the third sealing including a sealing branch separating the dosing chamber from the storage chamber and the conduit and also separating the conduit from the storage chamber, a first opening between the storage chamber and the conduit defining an inlet of the conduit, a second opening between the conduit and the dosing chamber defining an outlet of the conduit, the third sealing delimiting at least in part the dosing chamber, the storage chamber and the conduit, the sealing branch including a first branch for delimiting the dosing chamber, extending from the first lateral branch towards the upper branch around the outlet opening, and a second branch extending from the first branch for delimiting the conduit on an opposite side relative to the dosing chamber.

2. The container according to claim 1, wherein the first branch and the second branch define a Y-shaped structure of the third sealing.

3. The container according to claim 2, wherein the outlet opening is located between prongs of the Y-shaped structure defined by the first branch, the first branch surrounding the outlet opening.

4. The container according to claim 1, wherein the first sealing further comprises a second lateral branch, the first branch extending between the first lateral branch and the upper branch of the first sealing.

5. The container according to claim 1, wherein the second branch of the third sealing extends from a free end of the first branch of the third sealing.

6. The container according to claim 1, wherein the second branch of the third sealing comprises a vertical stretch extending along a direction Y of vertical extension of the container.

7. The container according to claim 1, wherein the second branch of the third sealing comprises a vertical stretch extending along a direction X of transversal extension of the container.

8. The container according to claim 1, wherein the joining seal comprises a fourth sealing for separating the dosing chamber from the storage chamber and extending from the first sealing, and the conduit includes a valve positioned along the fourth sealing between the front face wall and the rear face wall, the dosing chamber and the storage chamber being separated by the fourth sealing and in communication via the valve.

9. The container according to claim 8, wherein the fourth sealing extends around the outlet opening.

10. The container according to claim 8, wherein the valve is a one-way valve which allows passage of a product from the storage chamber to the dosing chamber, the valve comprising a fifth sealing delimiting the conduit.

11. The container according to claim 1, wherein the inlet is positioned within an upper half of the sealed enclosure.

12. The container according to claim 1, wherein the sealed enclosure is flexible.

* * * * *